United States Patent [19]

Rogers

[11] Patent Number: 4,609,045

[45] Date of Patent: Sep. 2, 1986

[54] METHOD AND APPARATUS FOR CLEANING THE SCREEN INLET PORTION OF A WATER WELL CASING

[76] Inventor: Sterlie R. Rogers, 104 Nimitz Dr., Dayton, Ohio 45431

[21] Appl. No.: 751,366

[22] Filed: Jul. 2, 1985

[51] Int. Cl.[4] ..... E21B 37/08

[52] U.S. Cl. ..... 166/312; 91/275; 166/53; 166/72; 166/75.1; 166/171; 166/379; 166/383

[58] Field of Search ..... 166/311, 312, 72, 74, 166/85, 75.1, 53, 383, 379, 171, 177; 91/410, 275; 15/56, 104.16, 104.05

[56] References Cited

U.S. PATENT DOCUMENTS

| | | | |
|---|---|---|---|
| 2,462,571 | 2/1949 | Thompson et al. | 91/275 |
| 2,721,614 | 10/1955 | Simmons | 166/383 |
| 3,208,728 | 9/1965 | Parks | 166/75.1 |
| 3,547,194 | 12/1970 | Morine | 166/312 |
| 3,583,489 | 6/1971 | Hutchison et al. | 166/312 |
| 3,894,476 | 7/1975 | Cobb | 91/410 |
| 4,176,586 | 12/1979 | Stoll et al. | 91/275 |
| 4,480,685 | 11/1984 | Gilbertson | 166/72 |
| 4,516,637 | 5/1985 | Winckler | 166/85 |

OTHER PUBLICATIONS

Ferrox, "Mould Cleaning"; Nov. 24, 1975.

*Primary Examiner*—James A. Leppink
*Assistant Examiner*—Hoang C. Dang
*Attorney, Agent, or Firm*—Robert L. Deddens

[57] ABSTRACT

A fluid operated cylinder is suspended from a crane by a cable and has a piston rod connected by a cable to a cleaning unit for supporting the cleaning unit within the screened inlet portion of a water well casing extending into the ground. Air is supplied to the cylinder through a solenoid valve which is controlled in response to movement of the piston to produce reciprocation of the piston and corresponding movement of the cleaning unit within the well casing.

8 Claims, 4 Drawing Figures

METHOD AND APPARATUS FOR CLEANING THE SCREEN INLET PORTION OF A WATER WELL CASING

BACKGROUND OF THE INVENTION

This invention relates to the removal of ground water from deep wells for municipalities, industrial plants, and other users of ground water from wells.

Present practice is to drill a hole down to the water-bearing sand formation, and to install a permanent upper casing for the well. Then, through an underreaming process, a larger space is carved out from the sand formation, below the upper casing. A tubular screen of proper diameter is then installed, connected to the bottom of the casing, centered in the underreamed space, and gravel of properly selected size is filled into the underreamed space to form a gravel wall or filter around the outside of the screen inlet portion of the casing.

A vertical turbine pump is then installed at the top of the casing which serves as a discharge pipe. When the pump is put into operation, the water in the sand formation is drawn through the gravel and through the screen into the discharge pipe, from which it is elevated by the pump for use. The screen retains the gravel, and the gravel wall retains the sands in the water bearing formation from passing into the well casing.

A major problem encountered with these types of large water wells is that some sand particles do eventually pass through the gravel to the screen inlet portion of the well casing. Over time, sand particles begin to cake up and clog the holes or louvers in the screen. Also, over time, depending upon conditions, lime contained in the water will accumulate around the screen and will also plug up the holes and louvers in the screen. As the sand and lime builds or cakes up, it closes off portions of the screen. This naturally reduces pumping efficiency, reduces intake of water, increases the pumping head, and increases the pumping cost.

When the water level falls off to a point near the top portion of the screen portion of the casing, and the flow rate decreases, it becomes necessary to perform an operation known as air agitation within the screen to break up and remove the clogged sand and lime, to thereby clean and open up the screen for increasing intake of water and pumping efficiency. It is necessary to perform the air agitation cleaning operation every 2 or 3 years in large municipal or industrial water wells.

Present air agitation and cleaning practice involves the steps of removing the pump with a crane, lowering a string of agitating pipe having a scrubbing or cleaning device at the lower end thereof for scrubbing the inside of the screen. An air pipe is inserted within the agitating pipe. Air under pressure is introduced through the air pipe into the agitating pipe and, concurrently, the agitating pipe is moved up and down causing the scrubbing device to scrape the inside of the screen. This motion and the air cooperates to cause a suction pressure which breaks up the sand and lime formations plugging the screen and causes the particles on the outside thereof to pass through the screen into the well casing. The air lifts the water inside the well casing up through the agitating pipe to thereby remove the sand and lime particles in the water from the well.

An important step in the air agitation cleaning operation is the scrubbing process. Typically, the agitation pipe with attached scrubbing and scraping device is alternately moved up and down with a two foot stroke. Power driven mean are provided to move the agitation pipe up and down inside the well casing to create the scrubbing action.

Under conventional practice, once the pump is pulled out of the well, the crane is moved off the site and a large cable tool or drilling rig is transported to the site. The rig utilizes a motor drive gear having an eccentric connection to a cable. The cable is connected to the top of the agitating cleaner unit or assembly, and the motor driven gear and cable alternately lifts the assembly a distance of two feet (or whatever length of stroke is desired), after which the assembly decends by gravity within the well casing a distance of two feet. The gear then lifts the cleaner assembly again to create the reciprocating movement of the scraping device at the end of the agitating pipe.

After a screen portion of the casing is scrubbed for a predetermined period of time, the unit is lowered two feet into the well casing, and the scrubbing action is repeated. This process is continued until the entire screen portion has been scrubbed, at all times using the pressurized air in combination with the scraping device to agitate the well and thereby break up or dislodge the caked sand and lime clogging the screen.

When the air agitation process is completed, the rig is removed from the site. The crane is then brought back to the site to pull the agitation pipe out of the well and to remount the pump over the well so that normal pumping may resume.

The above-described practice using a crane to remove the pump and to insert the agitating pipe into the well, then transporting the cable tool rig to the site to perform the cleaning function, and then removing the cable tool rig from the site and returning the crane to the site to pull the agitating pipe out of the well casing and to remount the pump, is extremely time consuming and costly.

SUMMARY OF THE INVENTION

The present invention is directed to improved method and apparatus for agitating and cleaning of clogged inlet screen portions of ground water well casings.

A primary object of the invention is to reduce the time and cost of agitating and cleaning the screen portions of clogged ground water well casings.

A further object of the invention is to eliminate need for a cable tool or drilling rig.

A further object of the invention is to provide means for agitating and cleaning screens within wells located in areas which will not accommodate cable tools or drilling rigs.

Other features, objectives and advantages of the invention will be apparent from the following description and accompanying drawings.

DESCRIPTION OF THE PREFERRED EMBODIMENT

Figure 1:
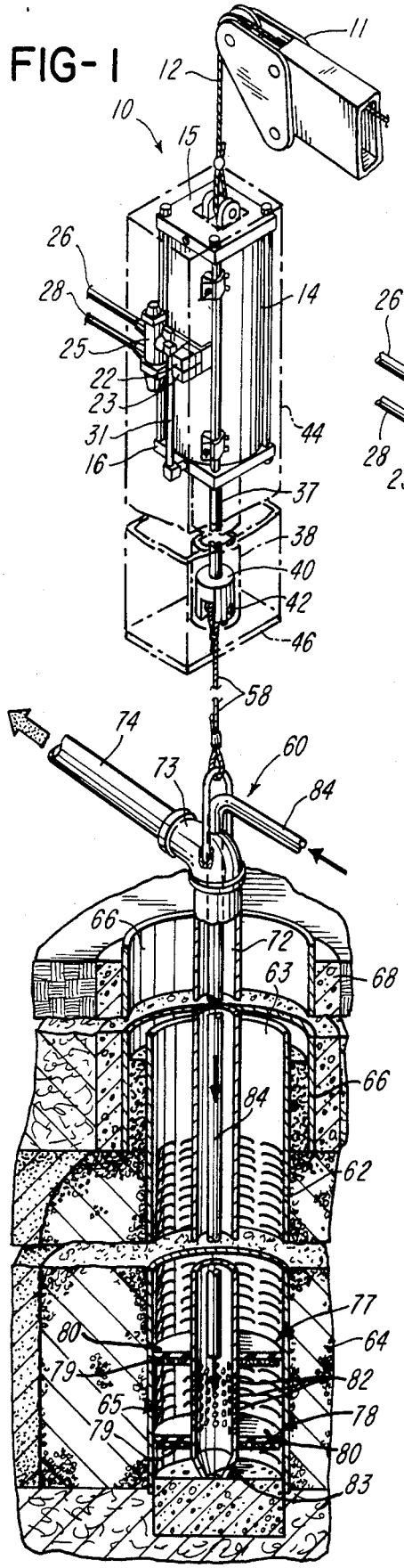
FIG. 1 is a perspective view of water well screen cleaning apparatus constructed in accordance with the present invention and supported by a crane above a water well.
Figure 2:
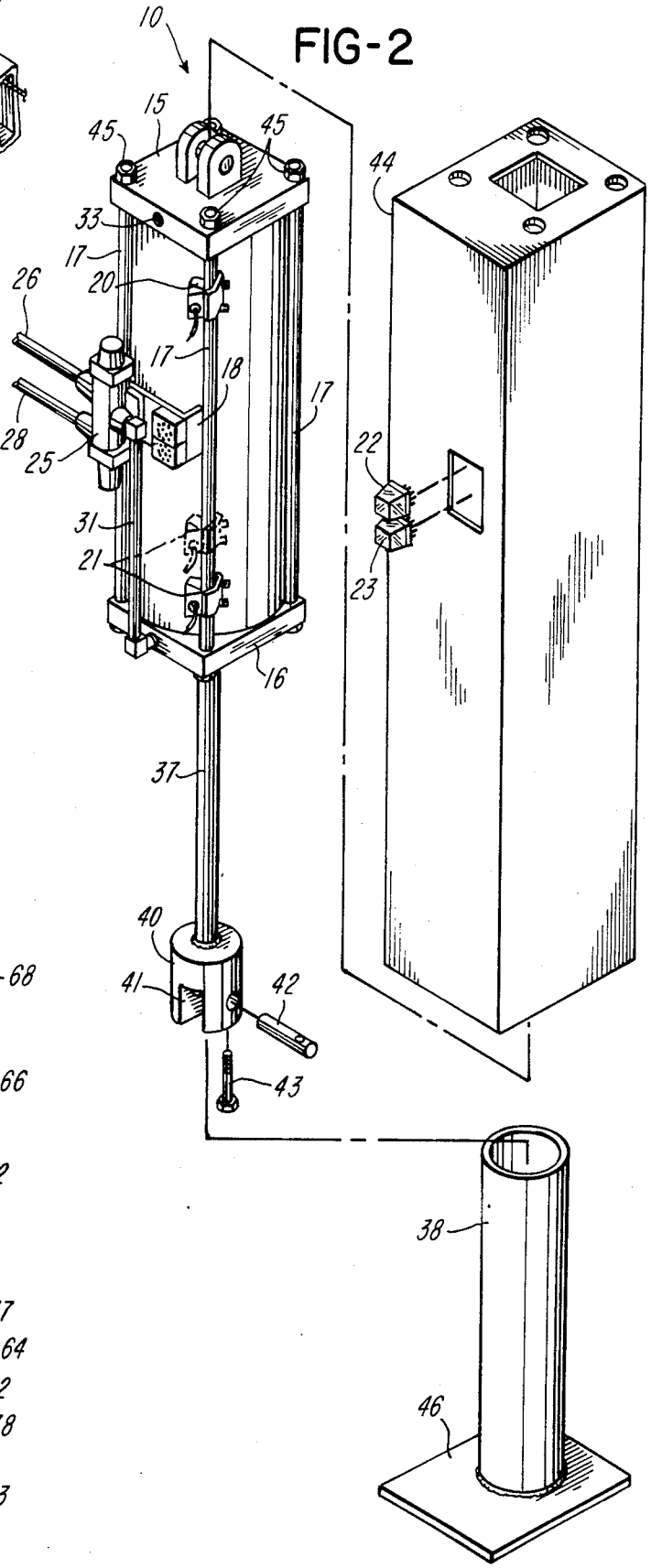
FIG. 2 is a larger exploded view of the fluid actuating apparatus shown in FIG. 1.

With reference to FIGS. 1 and 2, a fluid actuating apparatus 10 is shown suspended from the boom 11 of a crane, hoist or derrick having a support cable 12. The apparatus 10 includes a fluid or air actuated cylinder 14 including a non-magnetic (brass or aluminum) cylindrical tube confined between upper and lower end plates 15 and 16. Four cylindrical tie rods 17 extend longitudinally and connect the plates 15 and 16 to provide strength and rigidity, and two of the rods 17 support a valve support plate 18 and a pair of upper and lower magnetic limit switches 20 and 21.

Attached to the support plate 18 are a pair of replacable relays 22 and 23 and a three-way solenoid actuated valve 25. Fluid under pressure, either air or hydraulic fluid, and preferably air, is delivered to the inlet port of the valve 25 through a supply line 26. The exhaust port of the valve 25 is connected to an exhaust line 28. The valve 25 includes another port which is connected by a line 31 to an inlet passage 32 in the bottom plate 16 of the cylinder 14. The top plate 15 of the cylinder has an exhaust passage 33.

Figure 3:
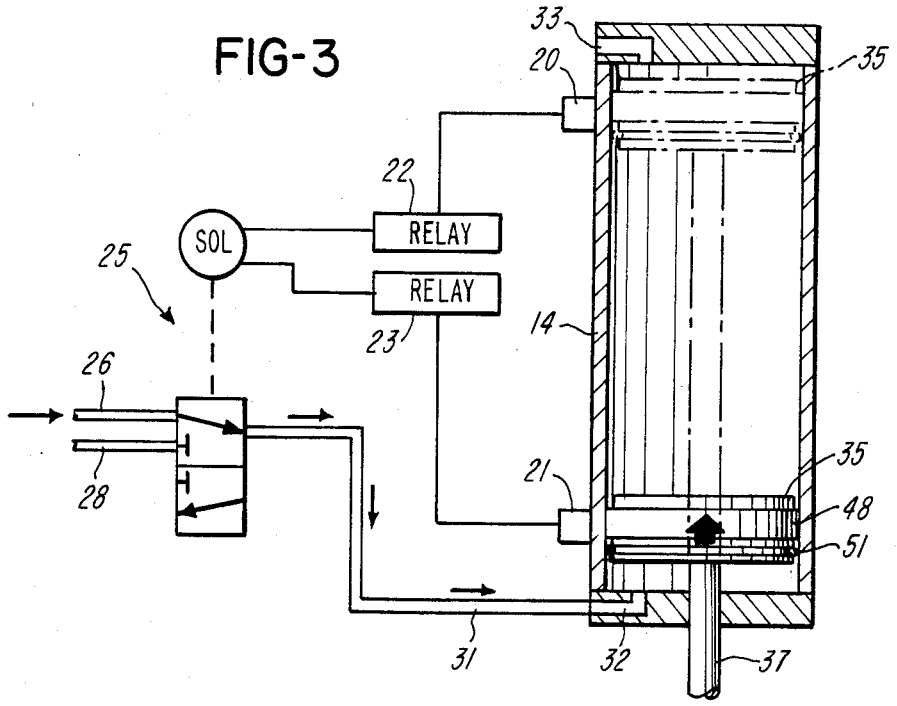
FIG. 3 is a diagramatic view of the fluid actuating apparatus of the invention, and illustrating fluid directed to the bottom of a fluid cylinder to effect upward movement.
Figure 4:
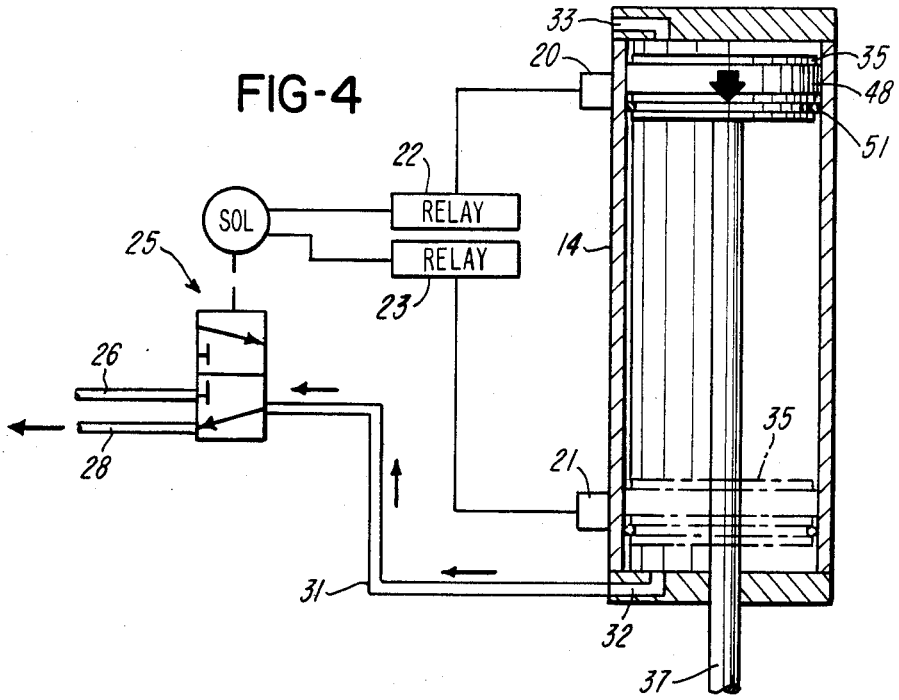
FIG. 4 is a diagramatic view of the apparatus and illustrating fluid exhausting from the bottom of the cylinder during downward movement.

Referring to FIGS. 2–4, the cylinder 14 includes a piston 35 connected to a piston rod 37. The rod 37 extends downwardly within a guide tube 38 and is connected to a cylindrical guide member 40 which has a slot 41 and receives a removable cross pin 42 secured by a screw 43.

The cylinder 14 is enclosed within a box-like housing 44 which is secured by a set of nuts 45 threaded onto the upper ends of the rods 17. The guide tube 38 is welded to a plate 46 which forms the bottom of the housing 44. The plate 46 has a hole for access to the guide number 40.

The magnetic limit switches 20 and 21 are mounted on one of the tie rods 17 and are adapted to interact with a band of magnetic material 48 (FIGS. 3 and 4) located in a circumferential groove within the piston 35. Preferably, the magnetic band 48 is capped with a bronze impregnated "Teflon" bearing strip (not shown) which is utilized to eliminate wear of the band 48 and to provide a bearing contact with the cylinder wall 51 with no metal-to-metal contact. The piston 35 is also provided with an O-ring 51 to provide a circumferential fluid or air seal.

Each of the limit switches 20 and 21 includes reed-type contact elements (not shown) which open or close as the elements sense the magnetic proximity of the moving magnet 48. The limit switches 20 and 21 may be adjustably positioned along the supporting tie rod 17 to establish the length of stroke desired. In a preferred embodiment of the invention, the limit switches 20 and 21 are positioned two feet apart to sense the piston 35 as it extends to an upper position (FIG. 3) and retracts to a lower position (FIG. 4).

The reed elements (not shown) of each limit switch 20 and 21 consist of two overlapping blades of ferromagnetic material. Each blade is connected to its own external wire lead. An air gap is defined between the overlapping ends of the blades in a normally open position. When a magnetic field is introduced, the magnetic induction in the gap causes the blades to attract each other and close for completing the external electrical circuit.

Referring to FIG. 1, a cable 58 is attached to the cross-pin 42 of the actuating apparatus 10 and supports cleaner unit or assembly 60 within a slotted screen portion 62 of a well casing 63. The screen portion 62 is surrounded by gravel 64 which is confined by the adjacent sand and earth. A surrounding upper well casing 66 is supported by concrete 68. The cleaner assembly 60 includes an agitating pipe 72 which is connected on top by an elbow 73 to an outlet or discharge line 74. The lower end portion of the pipe 72 carries a scraping device formed by an upper scraping disc assembly 77 and a lower scraping disc assembly 78. Between the discs 77 and 78, the pipe 72 has perforations or holes 82, and the lower end of the pipe 72 has a relatively small opening 83 for removing sand from the bottom of the well. An air supply tube 84 extends downwradly through the elbow 73 and the center of the pipe 72 to the upper disc assembly 77.

Each of the disc assemblies 77 and 78 includes a lower perforated metal disc 79 and an upper solid and flexible rubber scrapping disc 80. The outside diameter of each rubber disc 80 is the same diameter as the inside diameter of the screen portion 62 of the casing 63. The outside diameter of the metal disc 79 is slightly less than the inside diameter of screen portion 62. Both discs 79 and 80 are rigidly attached to the outside of the agitating pipe 72.

In operation of the actuating apparatus 10 of the invention, pressurized air is introduced through the line 26 to the valve 25. When the solenoid is energized (FIG. 3), air passes through the valve 25 and through line 31 to inlet passage 32 within the cylinder 14. The air forces piston 35 and connecting rod 37 upwardly to raise the cleaner assembly 60 located in the screen portion 62. The upward movement of the cleaner assembly 60 terminates when the limit switch 20 senses the magnetic band 48, causing the limit switch 20 to close and send a signal to the relay 22. The relay 22 then interrupts current passing to the solenoid of the valve 25, and the valve shifts or closes (FIG. 4) to stop flow of air into the bottom of the cylinder 14. During the upstroke of the piston 35, air above the piston 35 exhausts through the outlet passage port 33. When the valve 25 closes, the piston 35 reverses direction and moves downwardly due to the weight of the cleaner assembly 60. During the downstroke of the piston 35, air below the piston 35 exhausts from the cylinder 14 through line 31 and the line 28 connected to the outlet of the solenoid valve 25.

The downstroke terminates when the limit switch 21 senses the magnetic band 48. This causes the reed contacts or elements in limit switch 21 to close, sending a signal to the relay 23 which energizes solenoid valve 25. This causes the valve 25 to close the exhaust line 28 and open air supply line 26 to line 31. This causes air to be introduced again into the bottom of the cylinder 14 and to repressurize the bottom of the piston 35. The cycle is repeated again and again to effect an alternating upward and downward movement of the piston 35, rod 37 and member 40. As a result, the cleaner assembly 60 reciprocates vertically within the screen portion 62 of the well casing 63.

As the cleaner assembly 60 moves up and down with the piston 35, the cylindrical cleaning or scraping device or discs 77 and 78 at the bottom of the well scrape the inner cylindrical surface of the screen portion 62. At the same time, pressurized air is introduced into the pipe 72 near the top of the upper scraping disc 77 by means of the air supply tube 84 for creating an agitating and suction action on the outside of the screen portion 62. On the upstroke of the piston 35 and cleaning assembly 60, the rubber discs 80 scrape the inside of the screen portion 62 to dislodge and scrape sand and lime on the inside of screen portion 62. At the same time, the air bubbles form tube 84 and the upward movement of the disc 80 create a suction and agitating action within the chamber 65 between the disc assemblies 77 and 78 and on the outside of the screen portion 62 of the casing which dislodges and breaks up the sand and lime on the outside of the screen portion 62. The dislodged sand and lime particles from the outside of the screen portion 62 pass through the screen portion 62 into the chamber 64 and, together with the sand and lime particles scaped from the inside of screen portion 62, pass into the agitating pipe 72 through the holes 82 and are removed from the well by means of the rising air bubbles and water within the pipe 72. The assembly 60 is permitted to fall freely with the downstroke of the piston 35 as the rubber disc 79 bend upwardly and the water in the well passes through the perforations in the metal discs 80. Thus, the up and down movement of the disc assemblies 77 and 78 and the air agitation and suction action within the chamber 65 breaks up and disperses the sand and lime on the inside and outside of screen portion 62.

While the methods and apparatus herein described constitute a preferred embodiment of the invention, it is to be understood that the invention is not limited to this precise method and apparatus, and that changes may be made therein without departing from the scope of the invention.

What is claimed is:

1. Apparatus adapted to be supported by a cable depending from a crane for cleaning the screen inlet portion of a water well casing extending into the ground, comprising a cleaner assembly adapted to be lowered downwardly into the casing and having means for cleaning material from the inlet portion and means for removing the material cleaned from the inlet portion, a fluid actuated cylinder assembly including a piston supported for reciprocating movement within a cylinder, the cylinder assembly having means for connecting the cylinder assembly to the cable extending from the crane to suspend the cylinder assembly above the well casing with the crane, means extending downwardly from the cylinder assembly and connected to the cleaner assembly for supporting the cleaner assembly in suspended relation within the well casing, means including a fluid control valve for supplying fluid to the cylinder and for exhausting fluid from the cylinder, and means for actuating the valve to effect reciprocation of the piston and corresponding reciprocation of the cleaner assembly within the well casing for cleaning the screen inlet portion without requiring reciprocation of the cable depending from the crane.

2. Apparatus as defined in claim 1 wherein the fluid control valve comprise a solenoid actuated valve, and electrical control means for sensing movement of the piston within the cylinder.

3. Apparatus as defined in claim 2 wherein the electrical control means comprise a set of magnetically actuated limit switches, and permanent magnet means carried by the piston for alternately actuating the limit switches, and wherein said piston is confined within a non-magnetic tubular chamber.

4. Apparatus as defined in claim 1 including a rod connected to said piston, and means for guiding said rod during reciprocation of said piston.

5. Apparatus as defined in claim 4 wherein said guide means comprise a guide member connected to said rod, a housing connected to said cylinder for covering said cylinder and said rod and guide member, and a guide tube within said housing for guiding the rod during reciprocation of said piston.

6. Apparatus adapted to be supported by a cable depending from a crane for cleaning the screen inlet portion of a water well casing extending into the ground, comprising a cleaner assembly adapted to be lowered downwardly into the casing and having means for cleaning material from the inlet portion and means for removing the material cleaned from the inlet portion, a fluid actuated cylinder assembly including a piston supported for reciprocating movement within a cylinder, the cylinder assembly having means for connecting the cylinder assembly to the cable extending from the crane to suspend the cylinder assembly above the well with the crane, means extending downwardly from the cylinder assembly and connected to the cleaner assembly for supporting the cleaner assembly in suspended relation within the well casing, means including a fluid control valve for supplying fluid to the cylinder and for exausting fluid from the cylinder, means for actuating the valve in response to movement of the piston to effect reciprocation of the piston and corresponding reciprocation of the cleaner assembly within the well casing for cleaning the screen inlet portion without requiring reciprocation of the cable depending from the crane, and means for adjusting the actuating means for adjusting at least one limit of movement of the piston.

7. A method of cleaning the screen inlet portion of a water well casing extending into the ground, comprising the steps of forming a cleaning unit having means for cleaning material from the inlet portion and means for removing material cleaned from the inlet portion, suspending the cleaning unit from a fluid cylinder assembly having a piston movable axially within a cylinder, connecting the cylinder assembly to a cable extending from a crane, lowering the cleaning unit into the well casing with the cable and the cylinder assembly, supplying a fluid to the cylinder through a valve system, and actuating the valve system to produce reciprocating movement of the piston and corresponding reciprocating movement of the cleaning unit within the well casing for cleaning the screen inlet portion of the casing without requiring reciprocation of the cable depending from the crane.

8. A method as defined in claim 7 and inlcuding the step of controlling the actuation of the valve in response to movement of the piston.

* * * * *